US006609495B1

(12) United States Patent
Cornell et al.

(10) Patent No.: US 6,609,495 B1
(45) Date of Patent: Aug. 26, 2003

(54) ELECTRONIC CONTROL OF ENGINE BRAKING CYCLE

(75) Inventors: Sean O. Cornell, Gridley, IL (US); Scott A. Leman, Eureka, IL (US); Steven J. Funke, Princeville, IL (US)

(73) Assignee: Caterpillar Inc, Peoria, IL (US)

( * ) Notice: Subject to any disclaimer, the term of this patent is extended or adjusted under 35 U.S.C. 154(b) by 10 days.

(21) Appl. No.: 09/952,823

(22) Filed: Sep. 14, 2001

Related U.S. Application Data

(63) Continuation of application No. 09/740,405, filed on Dec. 19, 2000, now abandoned.

(51) Int. Cl.[7] ..... F02D 13/04
(52) U.S. Cl. ..... 123/321; 123/322; 123/323
(58) Field of Search ..... 123/321, 322, 123/323

(56) References Cited

U.S. PATENT DOCUMENTS 3,220,392 A 11/1965 Cummins
4,014,297 A * 3/1977 Rishavy et al. ..... 123/211
4,981,119 A 1/1991 Neitz et al.
5,146,890 A 9/1992 Gobert et al.
5,150,678 A 9/1992 Wittmann et al.
5,255,650 A 10/1993 Faletti et al.
5,386,809 A 2/1995 Reedy et al.
5,537,976 A 7/1996 Hu
5,634,447 A 6/1997 Rowells
5,647,318 A 7/1997 Feucht et al.
5,787,858 A 8/1998 Meneely
5,813,231 A 9/1998 Faletti et al.
5,967,115 A 10/1999 Konopka et al.
6,000,374 A 12/1999 Cosma et al.
6,148,258 A * 11/2000 Boisvert et al. ..... 701/99

* cited by examiner

*Primary Examiner*—Hoang Nguyen
(74) *Attorney, Agent, or Firm*—Liell & McNeil

(57) ABSTRACT

A method of engine braking includes a initial step of determining whether fuel injector tip temperatures are at or above a pre-determined temperature. If the injector tip temperatures are below the pre-determined temperature, then the electronic control module commands performance of dual event engine braking. If the injector tip temperatures are at or above the pre-determined temperatures, then the electronic control module commands the performance of single event engine braking. Such a strategy can achieve higher overall engine braking horsepower without risking the potential catastrophic dangers associated with injector tip overheating.

20 Claims, 6 Drawing Sheets

ELECTRONIC CONTROL OF ENGINE BRAKING CYCLE

RELATION TO OTHER APPLICATION

This application is a continuation of co-pending application Ser. No. 09/740,405, filed Dec. 19, 2000 with the same title, abandoned.

TECHNICAL FIELD

The present invention relates generally to electronically controlled engine compression release brakes, and more particularly to an electronic control strategy for transitioning between single event and dual event engine braking.

BACKGROUND

Single event engine compression release braking refers to the practice of operating an engine as an air compressor in a way that induces a retarding torque on the engine. This retarding torque translates into work machine braking when the engine is coupled to the machine's wheels or tracks by being in gear in a conventional manner. In typical single event engine braking, the exhaust valve is held closed during a portion of the engine's compression stroke. Sometime before the piston reaches top dead center, the exhaust valve is opened, and the compressed air in the cylinder is blown down into the exhaust line. The braking horsepower achieved by such an event is sensitive to several variables such as ambient pressure, ambient temperature, engine speed, etc., but is likely most sensitive to the timing of when the blow down event occurs. For instance, When blow down occurs near top dead center, the maximum braking horsepower is achieved; however, when the timing of the blow down event is advanced, the braking horsepower is correspondingly reduced since the pressure at blow down decreases with advances in blow down timing.

In recent years, engineers have discovered a way to increase engine braking horsepower by increasing the mass of air and initial pressure of the same toward the beginning of a compression stroke. This so called dual event engine braking briefly opens the exhaust valve near bottom dead center near the beginning of the compression stroke. This boosting portion of the dual event engine braking is timed to coincide with the blow down event of another cylinder such that the pressure wave from the blow down cylinder raises the initial pressure in the first cylinder. The blow down portion of the dual event engine braking is performed much in the same manner as a single event exhaust braking. In other words, if blow down occurs near top dead center, a maximum braking horsepower is achieved. As timing of the blow down event advances, braking horsepower correspondingly decreases. Because of the added mass to the cylinder and the increased initial pressure, dual event engine braking can produce braking horsepower as much as 15% or more over single event engine braking. A more detailed discussion of dual event engine braking is contained in co-owned U.S. Pat. No. 5,724,939 to Faletti et al.

While dual event engine braking can substantially increase engine braking horsepower, it can cause problems with other engine related components. For instance, fuel injector tips that are positioned in the engine cylinders but not brought into play during engine braking can experience substantial temperature increases as a result of engine braking, and especially as a result of dual event engine braking. The reasons for the substantial increase in injector tip temperatures are twofold. First, when the injector is operating when the engine is in a power mode, each injection spray carries some heat away from the injector tip, and serves as a threshold means of injector tip cooling. During engine braking, no injection takes place and thus this secondary cooling phenomenon attributed to fuel injection does not occur. When this factor is combined with the fact that air in the cylinder during dual event engine braking is substantially hotter than single event engine braking, the injector tip can run the danger of exceeding its tempering temperature, especially during sustained dual event engine braking at higher engine speeds.

If the injector tip exceeds its tempering temperature, it can lose its hardness at critically stressed areas, such as the needle valve seat. If this occurs, potentially catastrophic damage can occur due to potential tip failures from accelerated fatigue in the region of the needle valve seat. Other potential obstacles to the successful incorporation of dual event engine braking into practical use include excessive noise and possible turbine overspeed.

The present invention is directed to overcoming one or more of the problems set forth above.

SUMMARY OF THE INVENTION

In one aspect of the invention, a method of engine braking includes an initial step of determining whether fuel injector tip temperatures are at or above a predetermined temperature. If the injector tip temperatures are at or above the predetermined temperature, then single event engine braking is performed. If the injector tip temperatures are below the pre-determined temperature, then dual event engine braking is performed.

In still another aspect, a work machine includes an engine attached to a work machine housing. A plurality of electronically controlled engine brake actuators are attached to the engine. A plurality of fuel injectors are also attached to the engine. An electronic control module is in control communication with the plurality of electronically controlled engine brake actuators. The electronic control module includes means for transitioning from dual event engine braking to single event engine braking when tips of the fuel injectors are at or above a pre-determined temperature.

In another aspect of the invention, an electronic control module includes a means for determining whether fuel injector tip temperatures are at or above a predetermined temperature. In addition, the electronic control module includes means for commanding single event engine braking if the injector tip temperatures are at or above the predetermined temperature. Also included is a means for commanding dual event engine braking if the injector tip temperatures are below the pre-determined temperatures.

DETAILED DESCRIPTION

Figure 1:
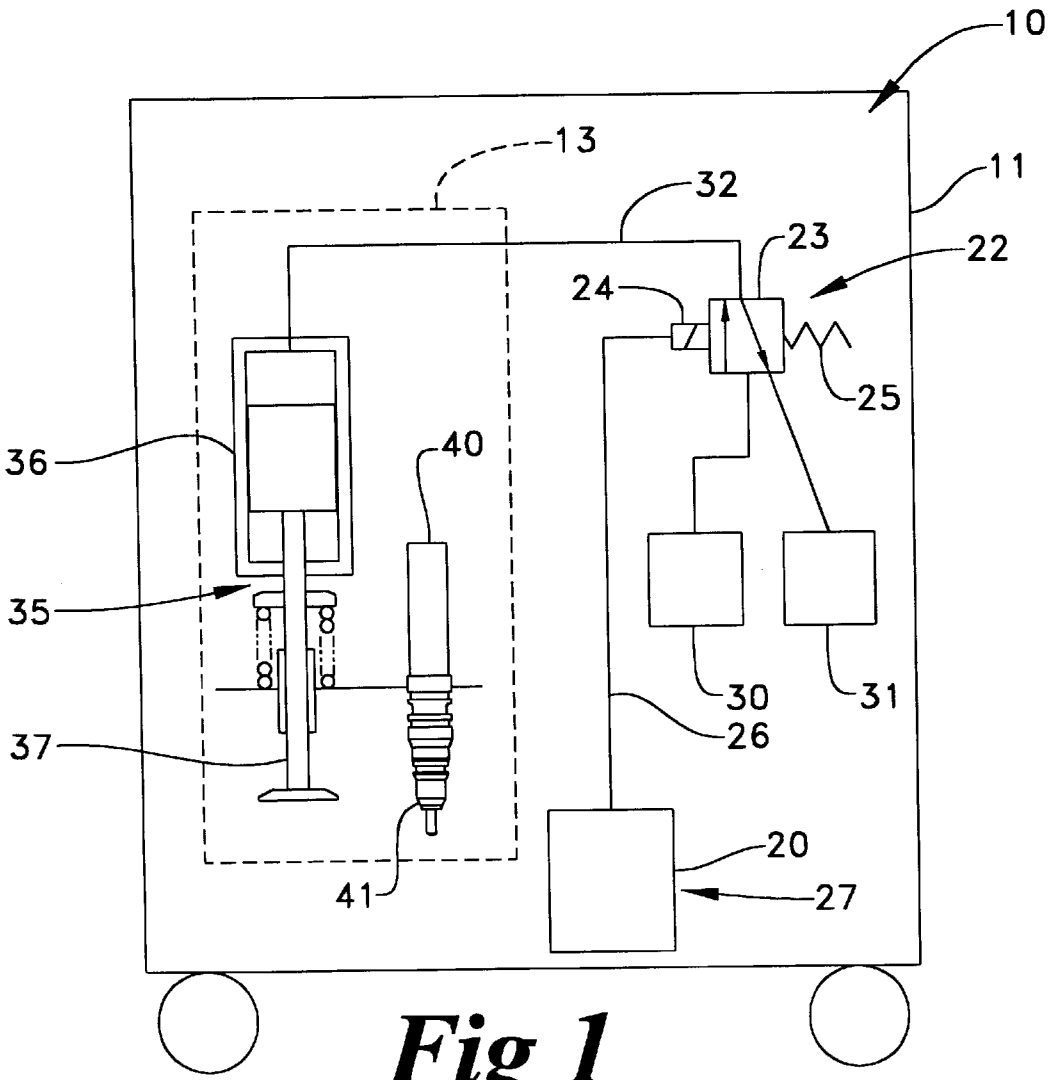
FIG. 1 is a schematic view of a work machine according to the present invention.

Referring to FIG. 1, a work machine 10 includes a work machine housing 11, within which is attached an engine 13. Work machine 10 can refer to any mobile machinery, including but not limited to heavy off road equipment, over the road trucks, buses, etc. Operation of engine 13 is controlled by an electronic control module 20 in a conventional manner. Engine 13 includes a plurality of cylinders (not shown). As in a conventional diesel engine, fuel injectors 40 include a tip 41 that is positioned in the engine cylinder and exposed to heat generated therein both through combustion and engine braking. Each cylinder includes an individual fuel injector 40 and at least one electronically controlled exhaust valve 35. In a preferred application of the present invention, engine 13 would be a diesel engine, and fuel injectors 40 and exhaust valves 35 would be electronically controlled hydraulically actuated systems that share a common actuation fluid, such as pressurized lubricating oil. Nevertheless, those skilled in the art will appreciate that the present invention could find potential application to any engine having electronically controlled engine brakes. In the illustrated embodiment, electronically controlled exhaust valve 35 includes an exhaust valve, a hydraulic exhaust valve actuator 36 and an exhaust valve member 37. Exhaust valve actuator 36 can be connected via an actuation fluid line 32 to either a source of high pressure actuation fluid 30 or a low pressure actuation fluid reservoir 31, depending upon the position of control valve 22. Control valve 22 includes a control valve member 23 that is attached to an electrical actuator 24, such as a solenoid or a piezo electric actuator, and biased to the position shown by a biaser, such as a spring 25. Electrical actuator 24 is in control communication with electronic control module 20 via control communication line 26 in a conventional manner.

Figure 2A:
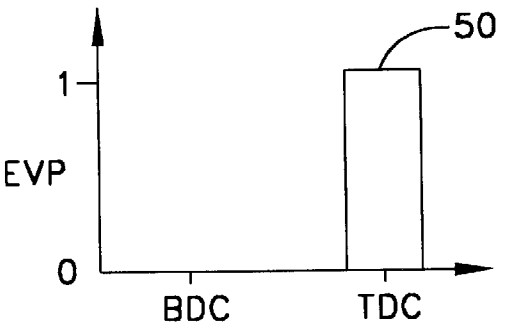
FIGS. 2*a* and 2*b* are graphs of exhaust valve position (EVP) verses cylinder piston position for single event and dual event exhaust braking, respectively.
Figure 2B:
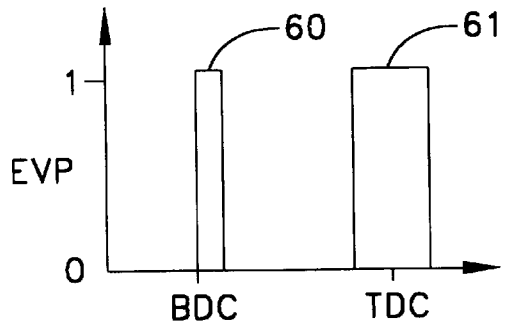

Referring to FIGS. 2*a* and 2*b*, graphs of exhaust valve position (EVP) verses cylinder position is illustrated. Zero (0) being when the valve is closed and one (1) corresponding to the valve being open. In FIG. 2*a* the single event engine braking blow down 50 occurs over a span of crank angle that typically begins some number of degrees before top dead center (TDC) and often ends some number of degrees into what would be the power stroke of the engine. FIG. 2*b* shows that a boost event 60 in a dual event engine braking cycle is positioned at or near when the piston is at bottom dead center (BDC). The blow down event 61 for the dual event engine braking is much the same as that of the single event shown in 2*a*. In both cases, the blow down event can consume a substantial portion of crank angle, which can be on the order of 20° C. to 70° C. depending upon engine speed. In part the reason for this is that the exhaust valve can only be opened so far when the piston is near top dead center such that a substantial flow restriction exists at the valve seat. This in turn results in a requirement of some substantial duration of time for the pressure within the cylinder to be fully released.

With regard to the boost event 60, it preferably should be timed to correspond to the blow down event of another neighboring cylinder so that the pressure wave arrives at the appropriate cylinder at the right timing to raise the initial pressure for the two event engine braking cycle. Those skilled in the art will recognize that because of engine geometry, firing order of cylinders, etc, timing of the boost event 64 might be slightly different for different cylinders in order to compensate for the distances over which the pressure wave must travel, etc. In addition, dual event braking horsepower can be further increased by appropriate adjustments to a variable geometry turbine. Those skilled in the art will appreciate that if the flow area past the exhaust valve can be made greater, such as by the use of valves that open in the reverse direction, the duration of the blow down events could be substantially shortened.

Figure 3:
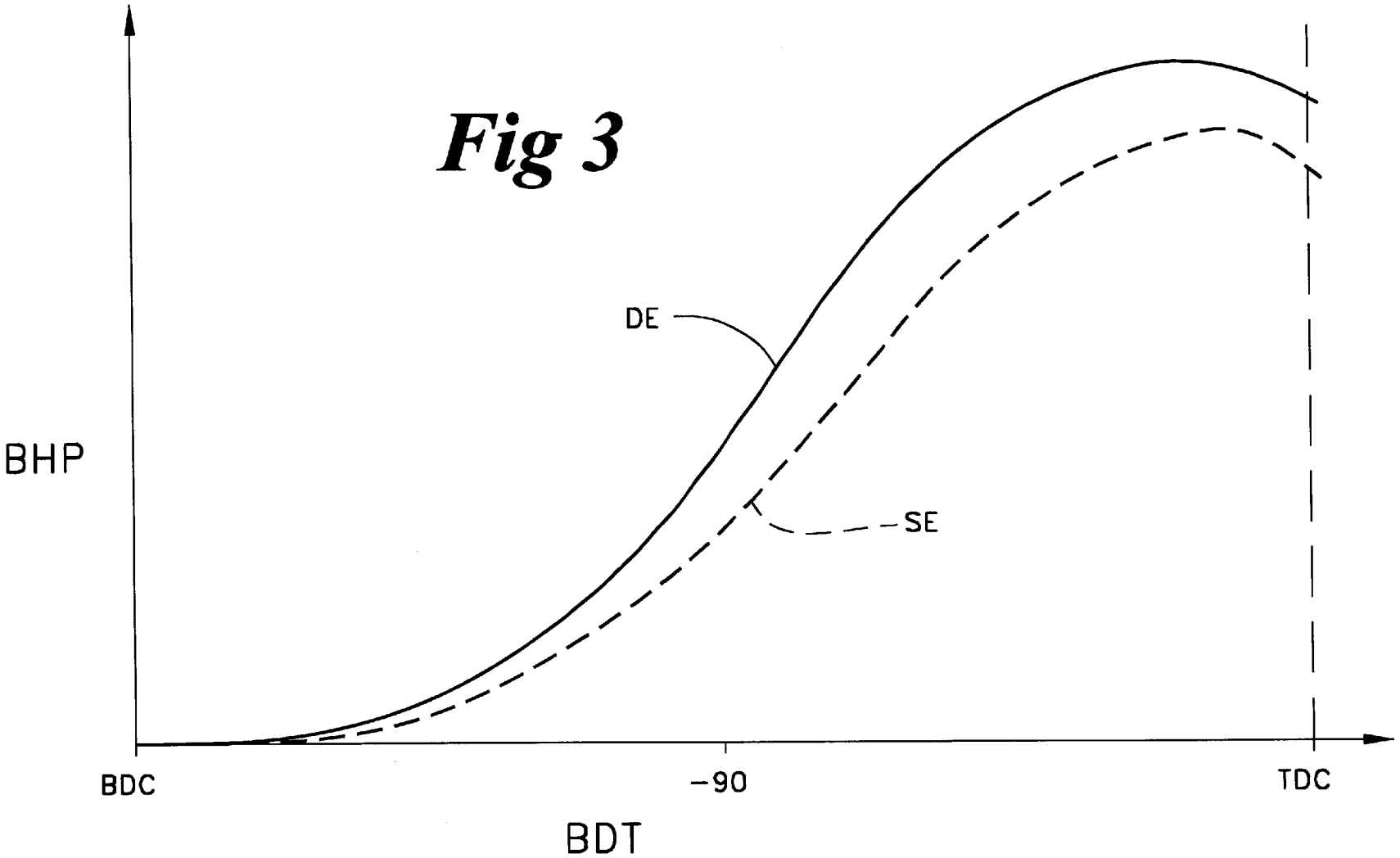
FIG. 3 is a graph of engine braking horsepower (BHP) verses blow down timing (BDT) expressed as a function of engine crank angle for dual event (DE) and single event (SE) engine braking.
Figure 4:
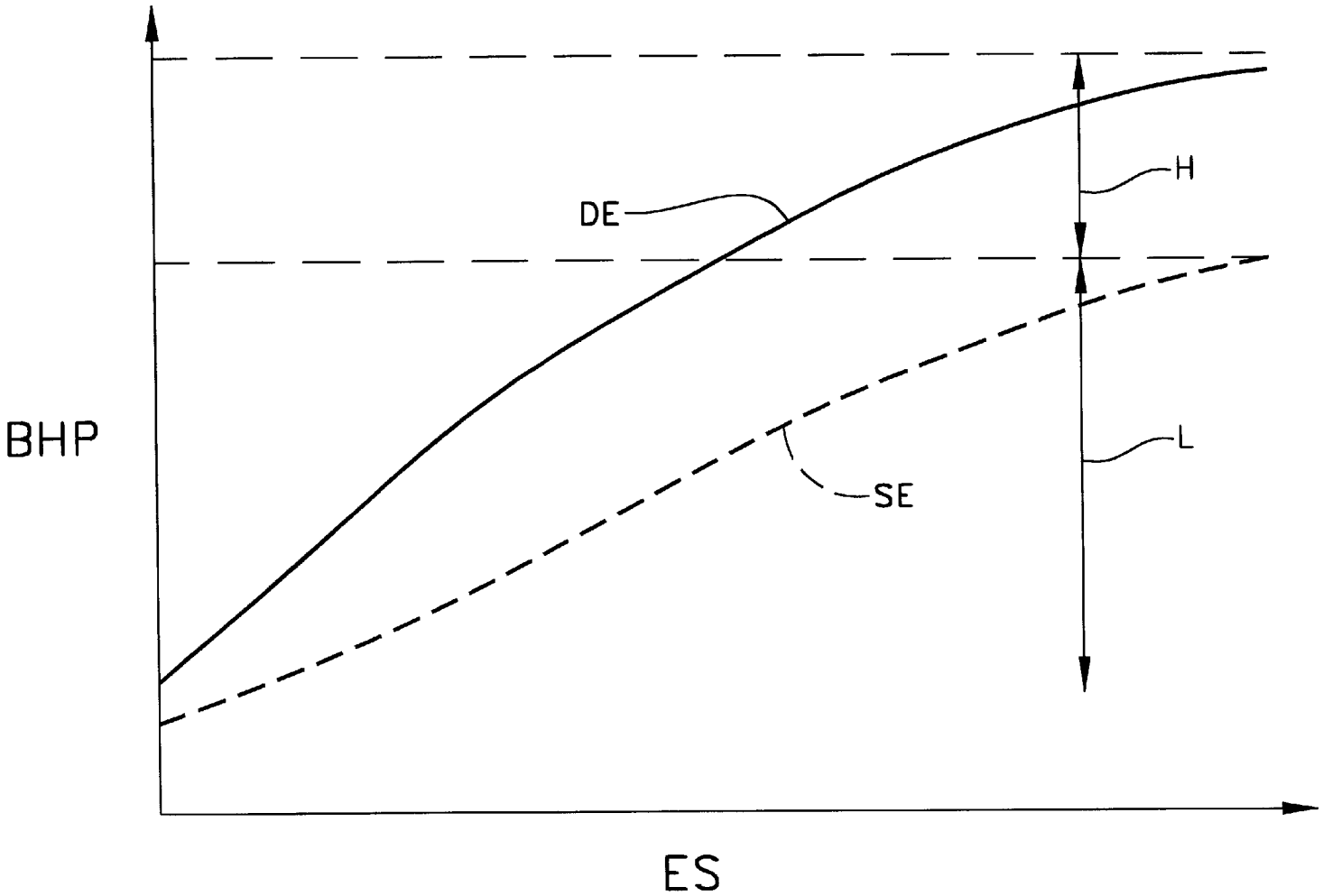
FIG. 4 is a graph of braking horsepower (BHP) verses engine speed (ES) for dual event (DE) and single even (SE) engine braking.

Referring to FIG. 3, braking horsepower (BHP) is graphed against blow down timing (BDT) that is expressed as crank angle for both dual event (DE) and single event (SE) engine braking. This graph illustrates that regardless of when the blow down event occurs, and assuming all other aspects are equal, the dual event braking cycle produces substantially more braking horsepower than single event engine braking. Referring in addition to FIG. 4, brake horsepower (BHP) is graphed against engine speed (ES) for both single event (SE) and dual event (DE) engine braking cycles. Both of these graphs illustrate that a high range (H) exists where the magnitude of exhaust braking is only possible with a dual event strategy. Also indicated is a lower range (L) over which the desired amount of exhaust braking horsepower can be achieved with either a dual event or a single event strategy. The present invention is concerned with equipping the electronic control module with appropriate logic to choose between dual event or single event engine braking strategies based upon various concerns such as injector tip temperature, noise levels, turbine speed and possibly energy consumption concerns. However, some of these concerns are not easily assessed. For example, injector tip temperature must generally be estimated based upon a correlation with other available sensory data because it is generally not realistic to position a temperature sensor at a location that could suitably and reliably monitor injector tip temperatures. It has been observed that the injector tip temperature almost never approach the tempering temperature when engine braking with a single event strategy.

In a preferred aspect of the invention, look-up tables of injector tip temperature would be created through correlations with engine speed and the number of previous braking cycles that precede the time at which the injector tip temperature is being estimated. For instance, when multiple braking events are happening in succession at a relatively higher engine speed, the injector tip tends to get hotter faster. When there have been no previous braking events but the engine is still at high speed, the injector tip may not yet be in danger of approaching its tempering temperature. Thus, through suitable testing, those skilled in the art could develop tables that could be used to estimate injector tip temperatures based upon variables such as engine speed, previous number of braking cycles, etc. that contribute to changes in injector tip temperatures. The concern regarding injector tip temperature relates to the possibility of catastrophic engine damage in the event of tip breakage due to accelerated fatigue failure.

Apart from injector tip temperature concerns, there are also concerns about overspeeding and damaging the engine's turbine. Thus, in one aspect of the present invention, turbine speed is monitored and the characteristics of the engine braking events are altered if turbine speed exceeds a pre-determined threshold. In addition, noise concerns might also be a grounds for altering an engine braking event. For instance, a dual event with an advanced blow down timing might produce the same amount of braking horsepower as a single event done at or near top dead center. However, the dual event with the earlier blow down would likely produce less noise, and may present the more desirable route especially in cases, such as in cities, where reduced noise levels are mandated.

INDUSTRIAL APPLICABILITY

Figure 5:
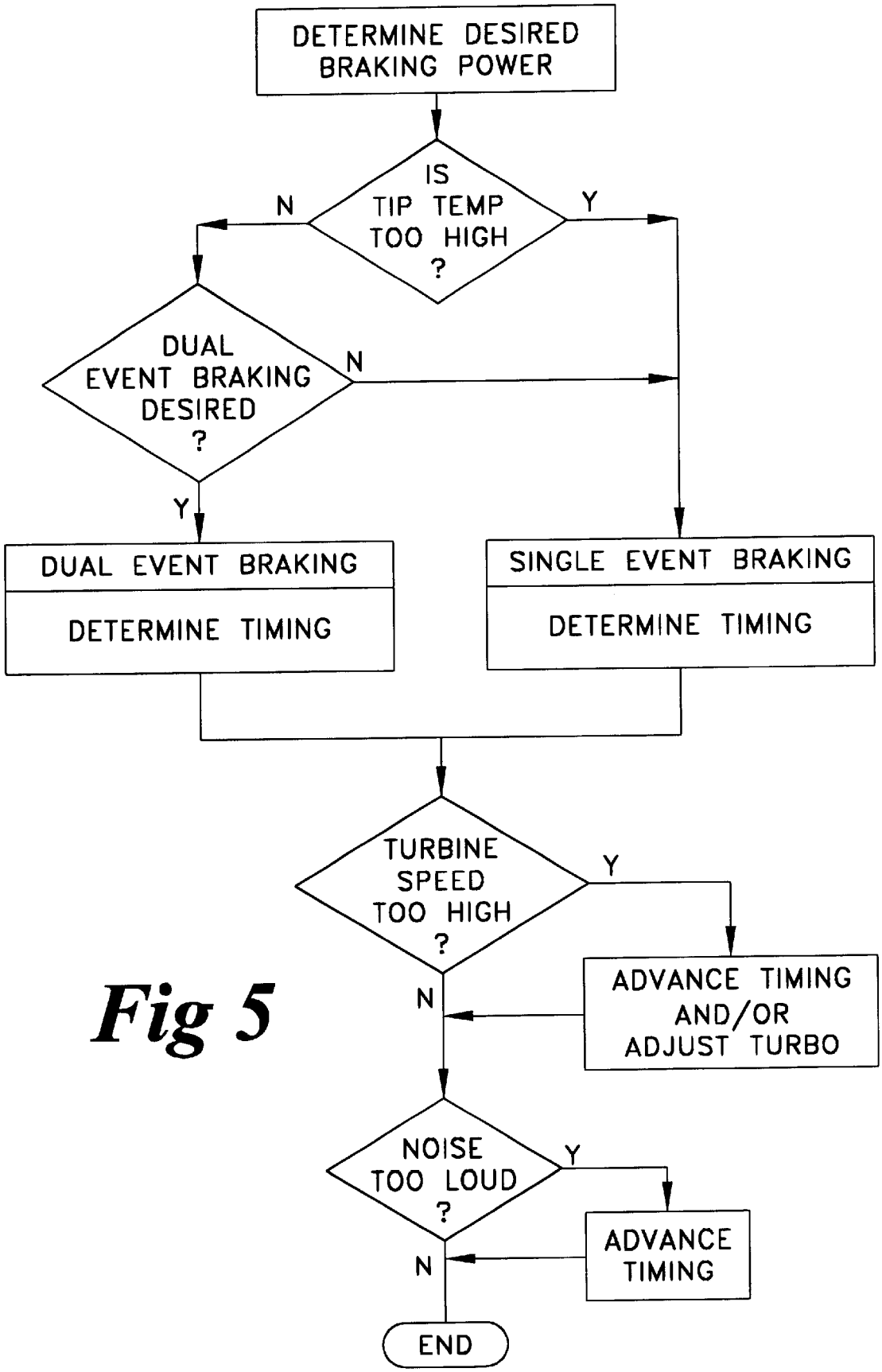
FIG. 5 is a software flow diagram for an electronic control module according to the present invention.

Referring to FIG. 5, a software flow diagram is illustrated that represents a preferred software strategy for incorporation into the electronic control module according to the present invention. First, the desired braking horsepower is determined. The origin of this signal could include a variety of factors such as brake pedal position, the speed of the work machine, engine speed, cruise control concerns, etc. Next, the first question asked is whether the injector tip temperature is too high. If so, the system commands a single event braking cycle, since it has been determined that single event braking rarely or never exacerbates injector tip temperature. Alternatively, if the tip temperature is not too high, another question asked is whether dual event braking is desired. Depending on the particular application, a number of considerations would go into answering this question. For instance, some applications may prefer to default toward dual event braking if system parameters indicate that dual event braking is available. In other applications, there might be the preferred desirability toward single event exhaust braking unless certain conditions known in the art are present.

Regardless of whether dual event braking or single event braking is chosen at this point in the logic flow, the next step is to determine the timing of the blow down event. For instance, if single event braking is chosen and the desired braking horsepower is beyond that possible with a single event braking, the timing that would correspond to the maximum possible single event braking would be chosen. On the other hand, if the desired braking horsepower is lower than the maximum power available, then the blow down event timing is advanced as per the graph of FIG. 3 so that the actual braking horsepower corresponds to the desired braking horsepower. The same considerations also go into determining the blow down timing for a dual event braking cycle if that it chosen.

After the blow down timing for the braking event is chosen, the next step is to ascertain whether the turbine speed is too high. If so, the system either commands the braking blow down event to advance in timing, which will result in less braking horsepower, or command an adjustment to the turbin to prevent turbine overspeed or possibly both. The next question is to determine whether the braking event will produce too much noise. If so, the timing of the blow down event is again advanced in order to reduce the noise output from the braking event. However, those skilled in the art will recognize that any timing advance will result in a corresponding reduction in the braking horsepower. Thus, if turbine speed is too high and/or noise levels exceed the predetermine maximum it is likely that the system will command an advanced timing braking event that will produce less braking horsepower than the desired braking horsepower. In these instances, the additional braking horsepower would need to be made up by other means, such as conventional wheel brakes or other known strategies.

Figure 6A:
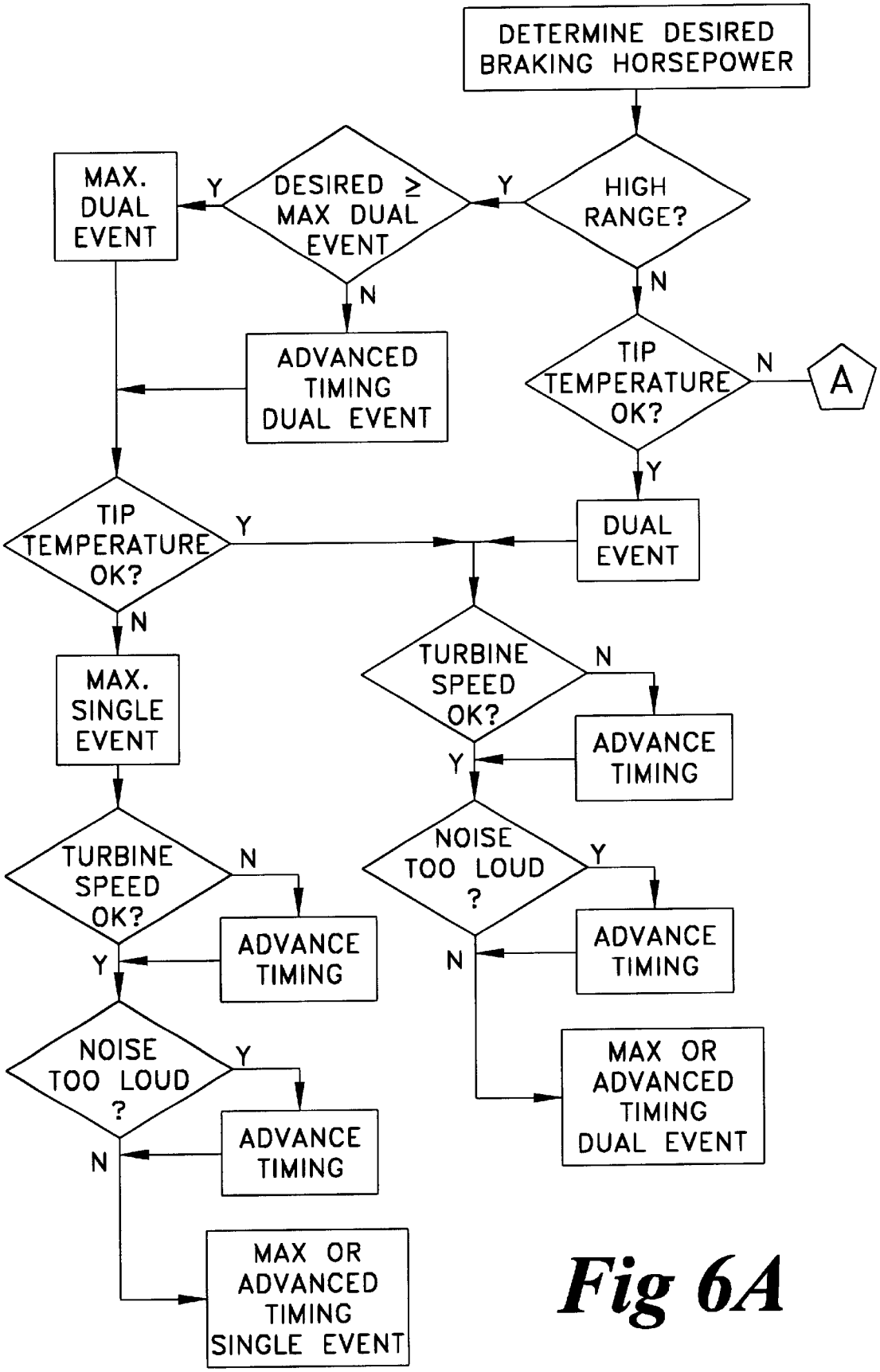
FIGS. 6A and 6B are an alternative software flow diagram.
Figure 6B:
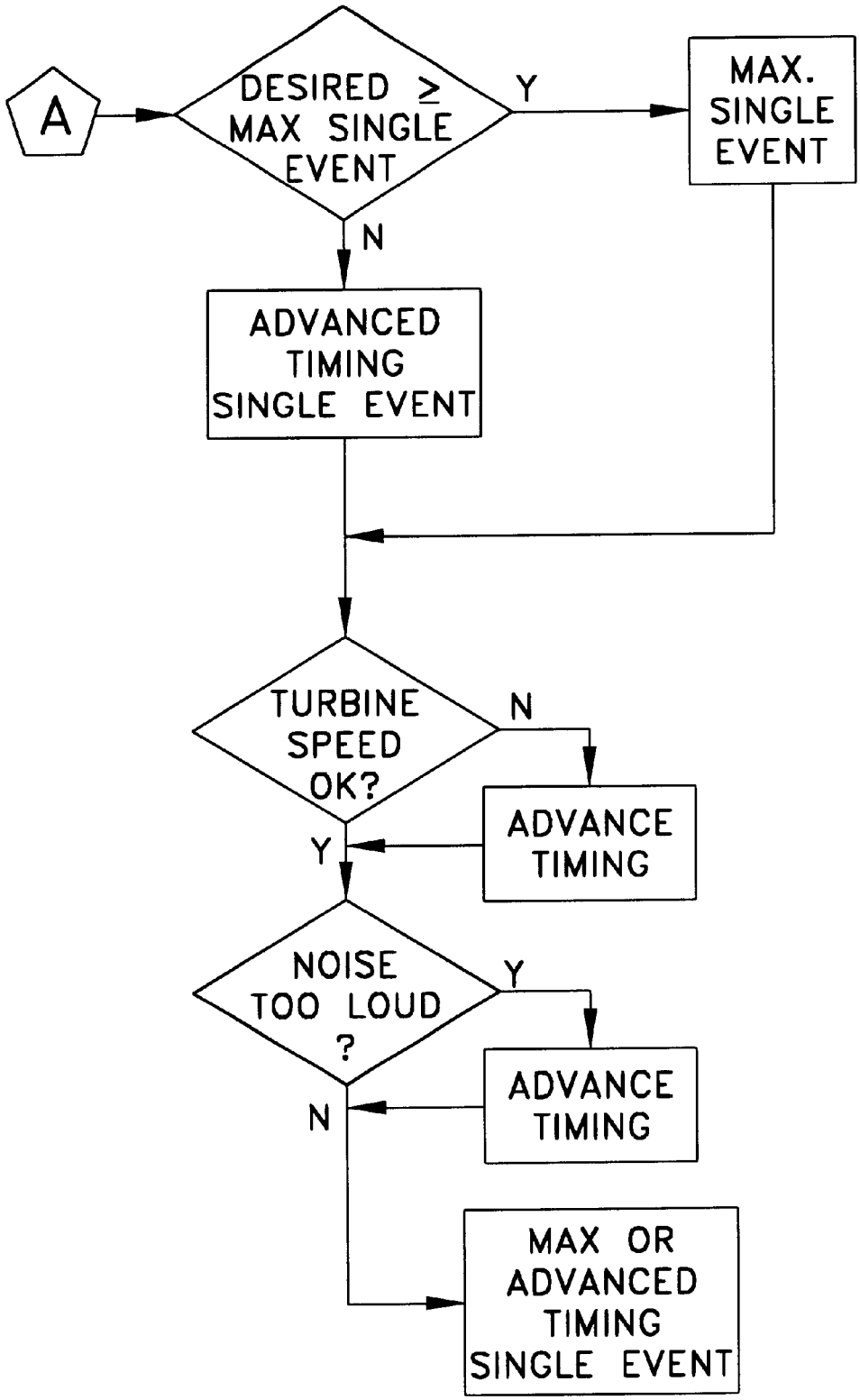

Referring to FIGS. 6A and 6B, an alternative logic flow diagram is illustrated that represents another software strategy for incorporation into the electronic control module according to the present invention. First, the desired braking horsepower is determined. The origin of this signal would include a variety of factors such as brake pedal position, cruise control concerns, etc. If the desired braking horsepower is in the high range, the next step is to determine whether it is beyond the braking horsepower possible with a maximum dual event. If so, the braking horsepower is set to be equal to the maximum dual event for that engine speed. Otherwise, a dual event strategy with an advanced timing is tentatively chosen in order to match the expected braking horsepower with the desired braking horsepower. Next, the electronic control module takes in various sensor inputs 27 (FIG. 1) in order to estimate the injector tip temperatures. As stated earlier, this is preferably accomplished with a look-up table that correlates engine speed to injector tip temperatures. A more sophisticated approach might also factor in the number of previous recent braking cycles in order to make the temperature estimate even more accurate.

Next, the electronic control module compares the estimated tip temperature to a pre-determined maximum temperature, which is preferably some number of degrees below the tempering temperature of the injector tip. If the injector tip temperatures are too high, the ECM tentatively changes from a dual event strategy to a maximum single event strategy. Thus, at this point the electronic control module has affectivity chosen a maximum braking horsepower that can be achieved without risking overheated injector tips. Next, the electronic control module checks to see if the maximum single event braking strategy presents a danger of turbine overspeed. If turbine overspeed is a problem at that time, the electronic control module further reduces the exhaust braking horsepower by advancing the blow down timing of the single event, or by commanding a turbine adjustment, or both. By doing so, less energy will be sent to the turbine and the issue of turbine overspeed will be addressed. Next, the expected noise output is compared to a maximum allowable noise output. If the expected noise produced by the then calculated engine braking event is too loud, the timing of the blow down event is further advanced to a point that the noise produced is acceptable. Finally, after going through this logic, the electronic control module is prepared to command either a maximum or advanced timing single event engine braking cycle.

Back again toward the top of the flow diagram is the question of whether the desired braking horsepower is in the higher or lower range. If in the lower range, the next question asked by the electronic control module is whether the injector tip temperatures are exceeding a pre-determined maximum. If injector tip temperatures are ok, then the electronic control module chooses a dual event engine braking strategy. After tentatively choosing a dual event strategy, the ECM goes through a turbine speed check and a noise production test that could result in advancing the timing of the dual event in order to prevent turbine overspeed or to lower noise production. Eventually, after proceeding through this logic, the electronic control module is prepared to command a maximum or advanced timing dual event braking strategy.

Returning again toward near the top of the flow diagram is another possibility in that the desired braking horsepower is in the lower range and the injector tip temperatures are deemed to be too high. In such a case, the next question asked is whether the desired braking horsepower is greater than that possible with a maximum single event strategy. If the answer is yes, the electronic control module tentatively chooses a maximum single event exhaust braking strategy. Otherwise, an advanced timing single event strategy is chosen to correspond the expected exhaust braking horsepower to the desired braking horsepower. After this determination, the electronic control module proceeds through the turbine speed check and noise production tests to possibly advance the timing of the blow down event to prevent turbine overspeed or to prevent the over production of noise. Finally, the electronic control module arrives at position of being prepared to command either a maximum or advanced timing single event exhaust braking cycle.

The process of determining whether the injector tip temperatures are in an acceptable range is preferably accomplished by initially measuring at least one variable that is common, such as engine speed, exhaust temperature and the number of previous exhaust braking cycles, that are correlated to injector tip temperature. Next, the injector tip temperatures are estimated based upon these sensed variables. The step of estimating the injector tip temperature could be accomplished by accessing a look-up table using the sensed variables as the coordinates in the table.

One enhancement on the present invention might be an override exhaust braking strategy in the event that an emergency condition is detected. For instance, if a potential engine overspeed condition is detected, the electronic control module may go into an override strategy that demands the maximum possible exhaust braking at that given engine speed without regard to injector tip temperatures, turbine speed or noise. The reason for this strategy is that it is better to destroy a turbine or overheat an injector and/or produce too much noise than it is to overspeed and possibly destroy a complete engine. Such an emergency condition could occur, for example, in a runaway down hill truck.

Those skilled in the art will appreciate that various modifications could be made to the present invention without departing from the intended scope. For instance, in the case of an engine equipped with hydraulically actuated exhaust valves, the exhaust braking would preferably occur in a two cycle mode such that an exhaust braking event would occur with each upward stroke of the piston for a given cylinder. Otherwise, the present invention contemplates a single exhaust braking event for each two revolutions of the engine's crank shaft as in a conventional four cycle mode. The present invention also contemplates the potential to selectively apply this strategy on an individual cylinder basis. For example, some brake actuators could operate in a dual event mode while others cool in a single event mode. The control could then cycle the injectors that are in the single event (or cooling) mode. This would accomplish injector tip cooling while generating braking power in the high range. In addition, the present invention also contemplates the possibility of using less than all available exhaust brake actuators to perform engine braking events. For instance, various concerns might make it desirable to use less than all of the engine brake actuators with blow downs near top dead center rather than advanced timing blow downs using all available engine brake actuators. In addition, the desired magnitude of engine braking horsepower might be such that the electronic control module need only command less than all of the engine valve actuators in order to produce the desired amount of engine braking. Those skilled in the art will appreciate that when the logic of the present invention is applied to a conventional engine, the result will in most instances be dual event engine braking at lower engine speeds and single event engine braking at higher engine speeds. Where the transition from one strategy to the other strategy will occur is dependent upon injector tip temperatures that may be different at any given time. Thus, those skilled in the art will appreciate that other aspects, objects and advantages of this invention can be obtained from a study of the drawings, the disclosure and the appended claims.

What is claimed is:

1. A method of engine braking comprising the steps of:

determining whether fuel injector tip temperatures are at or above a predetermined temperature;

if the injector tip temperatures are at or above the predetermined temperature, then perform single event engine braking; and if the injector tip temperatures are below the predetermined temperature, then perform dual event engine braking.

2. The method of claim 1 wherein said determining step includes the steps of:

measuring at least one variable that is correlated to injector tip temperature; and estimating the injector tip temperatures based upon said at least one variable.

3. The method of claim 2 wherein said at least one variable includes at least one of engine speed, exhaust temperature and number of previous engine braking cycles.

4. The method of claim 2 wherein said estimating step includes a step of accessing a look-up table.

5. The method of claim 1 including a step of advancing a blow down timing if a turbine speed is above a predetermined maximum turbine speed.

6. The method of claim 1 including the steps of advancing a blow down timing if an expected engine braking noise level exceeds a predetermined maximum noise level.

7. The method of claim 1 including the steps of:

determining a tempering temperature of the injector tips; and setting the predetermined temperature below the tempering temperature.

8. A work machine comprising:

a work machine housing;

an engine attached to said work machine housing;

a plurality of electronically controlled engine brake actuators attached to said engine;

a plurality of fuel injectors attached to said engine;

an electronic control module in control communication with said plurality of electronically controlled engine brake actuators; and said electronic control module including means for transitioning from dual event engine braking to single event engine braking when tips of said fuel injectors are at or above a predetermined temperature.

9. The work machine of claim 8 including means for measuring at least one variable that is correlated to injector tip temperature; and means for estimating the injector tip temperatures based upon said at least one variable.

10. The work machine of claim 9 wherein said at least one variable includes at least one of engine speed, exhaust temperature and number of previous engine braking cycles.

11. The work machine of claim 8 including a turbine attached to said engine; and a means for advancing a blow down timing if a turbine speed is above a predetermined maximum turbine speed.

12. The vehicle of claim 8 including a means for advancing a blow down timing if an expected exhaust braking noise level exceeds a predetermined maximum noise level.

13. An electronic control module comprising:

means for determining whether fuel injector tip temperatures are at or above a predetermined temperature;

means for commanding single event engine braking if the injector tip temperatures are at or above the predetermined temperature; and means for commanding dual event engine braking if the injector tip temperatures are below the predetermined temperature.

14. The electronic control module of claim 13 including means for measuring at least one variable that is correlated to injector tip temperature; and means for estimating the injector tip temperatures based upon said at least one variable.

15. The electronic control module of claim 14 wherein said at least one variable includes at least one of engine speed, exhaust temperature and number of previous engine braking cycles.

16. The electronic control module of claim 14 wherein said means for estimating includes a means for accessing a look-up table.

17. The electronic control module of claim 13 including a means for advancing a blow down timing if a turbine speed is above a predetermined maximum turbine speed.

18. The electronic control module of claim 13 including a means for advancing a blow down timing if an expected engine braking noise level exceeds a predetermined maximum noise level.

19. The electronic control module of claim 13 including a means for commanding an activation and deactivation of an electronically controlled engine brake actuator.

20. The electronic control module of claim 13 including means for increasing boost pressure in an exhaust line at least in part by commanding an adjustment to a variable geometry turbine.

* * * * *